US007730842B1

(12) United States Patent
Sebrow

(10) Patent No.: US 7,730,842 B1
(45) Date of Patent: Jun. 8, 2010

(54) QUILTING TEMPLATE AND METHODS

(76) Inventor: Sharon Sebrow, 596 Rutland Ave., Teaneck, NJ (US) 07666

( * ) Notice: Subject to any disclaimer, the term of this patent is extended or adjusted under 35 U.S.C. 154(b) by 712 days.

(21) Appl. No.: 11/737,415

(22) Filed: Apr. 19, 2007

(51) Int. Cl.
*D05B 37/00* (2006.01)
*B43L 7/00* (2006.01)

(52) U.S. Cl. ..... 112/117; 112/475.08; 112/122; 33/566

(58) Field of Classification Search ..... 112/122, 112/117–119, 152, 153, 320, 475.08, 475.18; 33/484, 562–566, 1 R; 83/13, 55; D10/64
See application file for complete search history.

(56) References Cited

U.S. PATENT DOCUMENTS

| | | | | | |
|---|---|---|---|---|---|
| D116,007 | S | * | 8/1939 | Bakallie | D10/62 |
| D141,882 | S | | 7/1945 | Matson | |
| 2,547,745 | A | * | 4/1951 | Cade et al. | 33/1 R |
| 2,797,493 | A | | 7/1957 | Watson | |
| 3,156,984 | A | * | 11/1964 | Palmer | 33/613 |
| 4,490,916 | A | * | 1/1985 | Blum | 33/565 |
| 4,565,006 | A | | 1/1986 | Vouyouka | |
| 4,584,780 | A | * | 4/1986 | Pressey | 33/563 |
| 4,608,939 | A | | 9/1986 | Lampley | |
| 4,945,642 | A | | 8/1990 | Saulietis | |
| 4,948,241 | A | * | 8/1990 | Setteducati | 359/856 |
| 5,201,783 | A | | 4/1993 | Peters | |
| 5,557,996 | A | | 9/1996 | Reber et al. | |
| 5,577,328 | A | * | 11/1996 | Kerry, Sr. | 33/563 |
| 5,579,670 | A | | 12/1996 | McCormick | |
| 5,638,605 | A | | 6/1997 | Sligar | |
| 5,791,062 | A | | 8/1998 | Walker | |
| 5,926,966 | A | | 7/1999 | Russell | |
| 6,276,070 | B1 | | 8/2001 | Hawley | |
| D549,115 | S | * | 8/2007 | Tucker | D10/64 |
| 7,383,640 | B2 | * | 6/2008 | Barry | 33/562 |
| D577,617 | S | * | 9/2008 | Tucker | D10/64 |
| D601,442 | S | * | 10/2009 | Haren | D10/64 |
| 2004/0049935 | A1 | * | 3/2004 | Tandy | 33/563 |
| 2005/0252019 | A1 | * | 11/2005 | Gordon et al. | 33/566 |

* cited by examiner

*Primary Examiner*—Ismael Izaguirre
(74) *Attorney, Agent, or Firm*—Arthur Jacob

(57) ABSTRACT

A template and a method guide a cutting tool during cutting of a quilt block having a selected one of at least two alternate kaleidoscope patterns from a quilting blank having a given pattern of sections seamed together along seam lines intersecting at a common seam origin. The template provides right angle corners and obtuse angle corners for accommodating the alternate kaleidoscope patterns, and includes cutting guides and registration indicators which when registered with seam lines of the quilting blank locate one or more of the cutting guides for cutting one or more segments of the border of a selected kaleidoscope pattern. Indexing of the template and the quilting blank relative to one another relocates the cutting guides for cutting further segments of the border to complete the selected kaleidoscope pattern.

19 Claims, 11 Drawing Sheets

QUILTING TEMPLATE AND METHODS

The present invention relates generally to the art of quilting and pertains, more specifically, to a template and methods for using the template to create a quilt block having a selected one of alternate quilting patterns.

The art of quilting has been practiced for a very long time. While quilting probably originated in ancient Egypt and China, it was not until the mid-nineteenth century that quilting began to be practiced more widely throughout Europe and America. The increased availability of manufactured textiles together with the advent of the sewing machine enabled more and more quilters to create a variety of quilting designs.

A favored technique for constructing a quilt of unique design is to sew together quilt blocks of selected patterns. The quilt block itself is made up of pieces of fabric, or patches, cut to shape and sewn together to form the desired pattern. One of the more popular patterns in quilt blocks used by present day quilters is known as the kaleidoscope pattern wherein the quilt block is comprised of an array of wedge-shaped patches having a common wedge angle at a wedge point, the patches being joined together with the wedge points placed at a common central origin and the wedge-shaped patches radiating outwardly from the origin and arrayed circumferentially around the origin. More particularly, a typical kaleidoscope patterned block will have an overall square configuration comprised of either: (i) eight basic fabric patches in the form of eight isosceles triangles having an apex angle of 45°, with all of the apices placed at a common central origin, and four additional smaller isosceles triangular patches each joined to the base of an alternate basic patch to complete a square quilt block having twelve patches in a kaleidoscope pattern; or (ii) four such basic patches joined with four diamond kite-shaped patches, also having an apex angle of 45°, with the basic patches and the diamond kite-shaped patches being arrayed alternately circumferentially about the common central origin to establish the square kaleidoscope patterned quilt block.

While the kaleidoscope pattern is highly desirable, it is more difficult to construct a quilt block incorporating that pattern, especially for beginners, primarily due to the necessity for getting all of the apices, or wedge points, to come together at the common origin, and to locate the common origin precisely at the center of the quilt block. Because of this difficulty, the kaleidoscope patterned quilt block has been avoided by quilters at the beginner level and by "quick" quilters. The present invention provides a template and methods of using the template for simplifying the creation of a quilt block having a selected kaleidoscope pattern. As such, the present invention attains several objects and advantages, some of which are summarized as follows: Provides a single template, of relatively simple design and construction, for use in creating a quilt block having a selected one of alternate kaleidoscope patterns; simplifies the procedure in creating a quilt block having a selected kaleidoscope pattern; promotes accuracy of detail in a quilt block having a kaleidoscope pattern; reduces the time necessary to create a quilt block having a kaleidoscope pattern; enables even a novice quilter to create a more intricate kaleidoscope patterned quilt block with ease, utilizing a simple, more basic quilt block as a starting blank; provides a single template for creating kaleidoscope patterned quilt blocks of different sizes, all with increased ease; encourages quilters to move forward toward developing greater skill in creating a wider variety of quilt designs; makes available an easy-to-use simple and inexpensive template for widespread use in creating quilts bearing highly desirable kaleidoscope patterns.

The above objects and advantages, as well as further objects and advantages, are attained by the present invention, which may be described briefly as a template for guiding a cutting tool during cutting of a quilt block having a selected one of at least two alternate kaleidoscope patterns from a quilting blank having a given pattern of sections seamed together along seam lines intersecting at a common seam origin, the selected kaleidoscope pattern having a prescribed peripheral border, the template comprising: a plate having a peripheral edge including a plurality of cutting guides extending along the peripheral edge, the peripheral edge including at least two right angle corners and at least four obtuse angle corners; and at least two adjacent registration indicators on the plate, the registration indicators being arrayed circumferentially about a template origin and spaced apart in circumferential directions such that upon first registering the two adjacent registration indicators and the template origin respectively with two adjacent seam lines and the seam origin of the quilting blank, at least one cutting guide will be located for guiding the cutting tool along a cut line corresponding to a segment of the border of the selected kaleidoscope pattern, and upon indexing the plate and the quilting blank relative to one another to register the two adjacent registration indicators and the template origin respectively with another two adjacent seam lines and the seam origin of the quilting blank, the one cutting guide will be relocated for guiding the cutting tool along another cut line corresponding to another segment of the border of the selected kaleidoscope pattern.

In addition, the present invention provides a method for guiding a cutting tool during cutting of a quilt block having a selected one of at least two alternate kaleidoscope patterns from a quilting blank having a given pattern of sections seamed together along seam lines intersecting at a common seam origin, the selected kaleidoscope pattern having a prescribed peripheral border, the method comprising: providing a template having a peripheral edge including a plurality of cutting guides extending along the peripheral edge, the peripheral edge including right angle corners and obtuse angle corners, and at least two adjacent registration indicators on the template, the registration indicators being arrayed circumferentially about a common template origin and spaced apart in circumferential directions; registering the two adjacent registration indicators and the template origin respectively with two adjacent seam lines and the seam origin of the quilting blank to locate at least one cutting guide along a cut line corresponding to a first segment of the border of the selected kaleidoscope pattern; guiding the cutting tool along the cutting guide to cut the first segment of the border of the selected kaleidoscope pattern; indexing the template and the quilting blank relative to one another to register the two adjacent registration indicators and the template origin respectively with another two adjacent seam lines and the seam origin of the quilting blank to relocate the one cutting guide along a second cut line corresponding to a second segment of the border of the selected kaleidoscope pattern; guiding the cutting tool along the cutting guide to cut the second segment of the border of the selected kaleidoscope pattern; and repeating the aforesaid indexing and cutting until the quilt block is complete.

Further, the present invention includes a method for guiding a cutting tool during cutting of a quilt block having a selected one of at least two alternate kaleidoscope patterns from a quilting blank having a given pattern of sections seamed together along seam lines intersecting at a common seam origin, the selected kaleidoscope pattern having a prescribed peripheral border, the method comprising: providing a template having a peripheral edge including a plurality of cutting guides extending along the peripheral edge, the peripheral edge including right angle corners and obtuse angle corners, the cutting guides including at least some cutting guides extending between adjacent obtuse angle corners, and adjacent registration indicators on the template, the registration indicators being arrayed circumferentially about a common template origin and spaced apart in circumferential directions; registering adjacent registration indicators and the template origin respectively with adjacent seam lines and the seam origin of the quilting blank to locate the some cutting guides along cut lines corresponding to segments of the border of the selected kaleidoscope pattern; guiding the cutting tool along the some cutting guides to cut segments of the border of the selected kaleidoscope pattern; indexing the template and the quilting blank relative to one another to register adjacent registration indicators and the template origin respectively with further adjacent seam lines and the seam origin of the quilting blank to relocate the some cutting guides along further cut lines corresponding to further segments of the border of the selected kaleidoscope pattern; and guiding the cutting tool along the some cutting guides to cut the further segments of the border of the selected kaleidoscope pattern.

The present invention will be understood more fully, while still further objects and advantages will become apparent, in the following detailed description of preferred embodiments of the invention illustrated in the accompanying drawing, in which.

Figure 1:
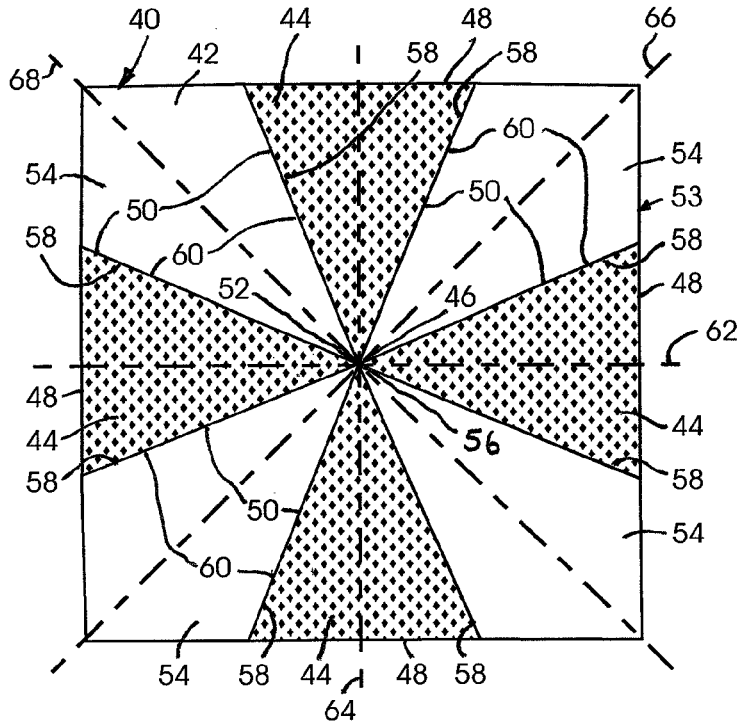
FIG. 1 is plan view of a quilt block having an eight-patch version of a kaleidoscope pattern.

Referring now to the drawing, and especially to FIG. 1 thereof, a quilt block to be created using the present invention is illustrated in the form of quilt block 40 having a kaleidoscope pattern 42 in an eight-patch version. The eight patches include four wedge-shaped patches in the form of triangular patches 44 each having the configuration of an isosceles triangle with an apex 46, an opposite base 48 and sides 50 extending from the apex 46 the base 48. The patches 44 are arranged so that the apices 46 come together at a common origin 52, preferably located at the center of the quilt block 40, the quilt block 40 having an overall square configuration. The patches 44 are arrayed so as to radiate outwardly from the origin 52 to peripheral border 53 of the quilt block 40, and to be spaced circumferentially from one another about the origin 52. The eight patches further include four wedge-like patches in the form of diamond kite-shaped patches 54 each having an apex 56 located at the origin 52 and sides 58 radiating outwardly from the origin 52 toward the border 53, placing patches 54 circumferentially between patches 44 so that patches 44 and 54 alternate circumferentially about origin 52 to establish the square quilt block 40. The patches 44 and 54 are sewn together along contiguous sides 50 and 58 to create seams along seam lines 60, which seams integrate the patches 44 and 54 into a complete quilting patch 40. Each of the patches 44 and 54 has an apex angle of 45° so that the pattern is symmetrical about orthogonal axes 62 and 64, and about diagonal axes 66 and 68; hence, the term "kaleidoscope" is used to identify the pattern. An almost infinite variety of designs is made available by merely being able to choose the color and design of the textiles used for each of the patches 44 and 54.

Figure 2:
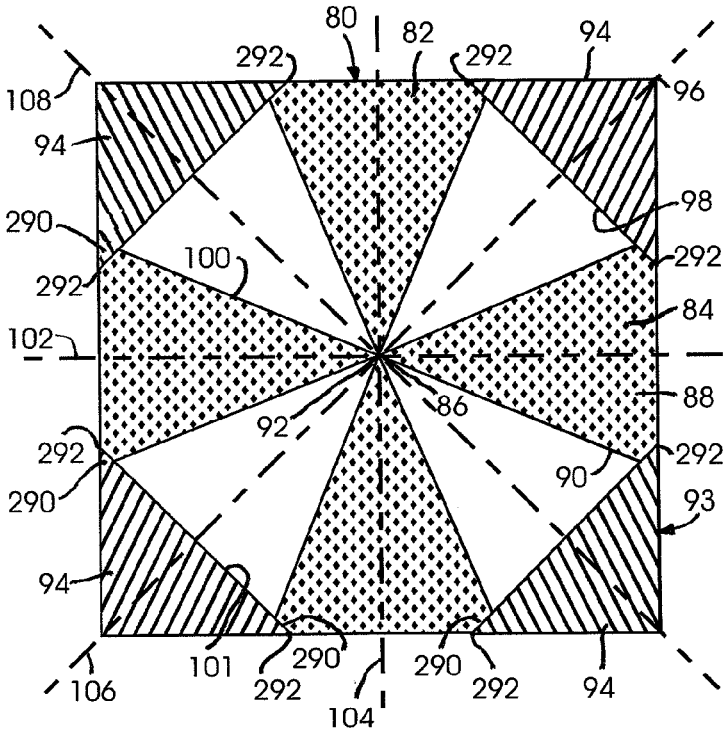
FIG. 2 is a plan view of a quilt block having a twelve-patch version of a kaleidoscope pattern.

Turning now to FIG. 2, another quilt block to be created using the present invention is illustrated in the form of quilt block 80 having an alternate kaleidoscope pattern 82 in a twelve-patch version. The twelve patches include eight wedge-shaped patches in the form of triangular patches 84 each having the configuration of an isosceles triangle with an apex 86, an opposite base 88 and sides 90 extending from the apex 86 the base 88. The patches 84 are arranged so that the apices 86 come together at a common origin 92, preferably located at the center of the quilt block 80, the quilt block 80 having an overall square configuration. The patches 84 are arranged so as to radiate outwardly from the origin 92 to peripheral border 93 of the quilt block 80, and to be arrayed circumferentially about the origin 92. The twelve patches further include four further wedge-like patches 94 in the form of smaller isosceles triangles, each having an apex 96 and a base 98. Bases 98 match bases 88 and the apex angle at each apex 96 is 90° so that upon placement of patches 94 contiguous with alternate patches 84, with the bases 98 in juxtaposition with corresponding bases 88, as shown, a fully square quilt block 80 is established, bearing the twelve-patch version kaleidoscope pattern 82. The patches 84 are sewn together along contiguous sides 90 to create radial seams along seam lines 100, which seams integrate the patches 84. The patches 94 are sewn to corresponding patches 84 along matching bases 88 and 98 to create further seams along seam lines 101, which further seams integrate patches 94 with patches 84 to complete quilting patch 80. Each of the patches 84 has an apex angle of 45°, while the patches 94 have an apex angle of 90°, so that the pattern is symmetrical about orthogonal axes 102 and 104, and about diagonal axes 106 and 108, rendering the pattern "kaleidoscopic". An even greater variety of designs is made available by being able to choose the color and design of the textiles used for each of the twelve patches 84 and 94.

Figure 3:
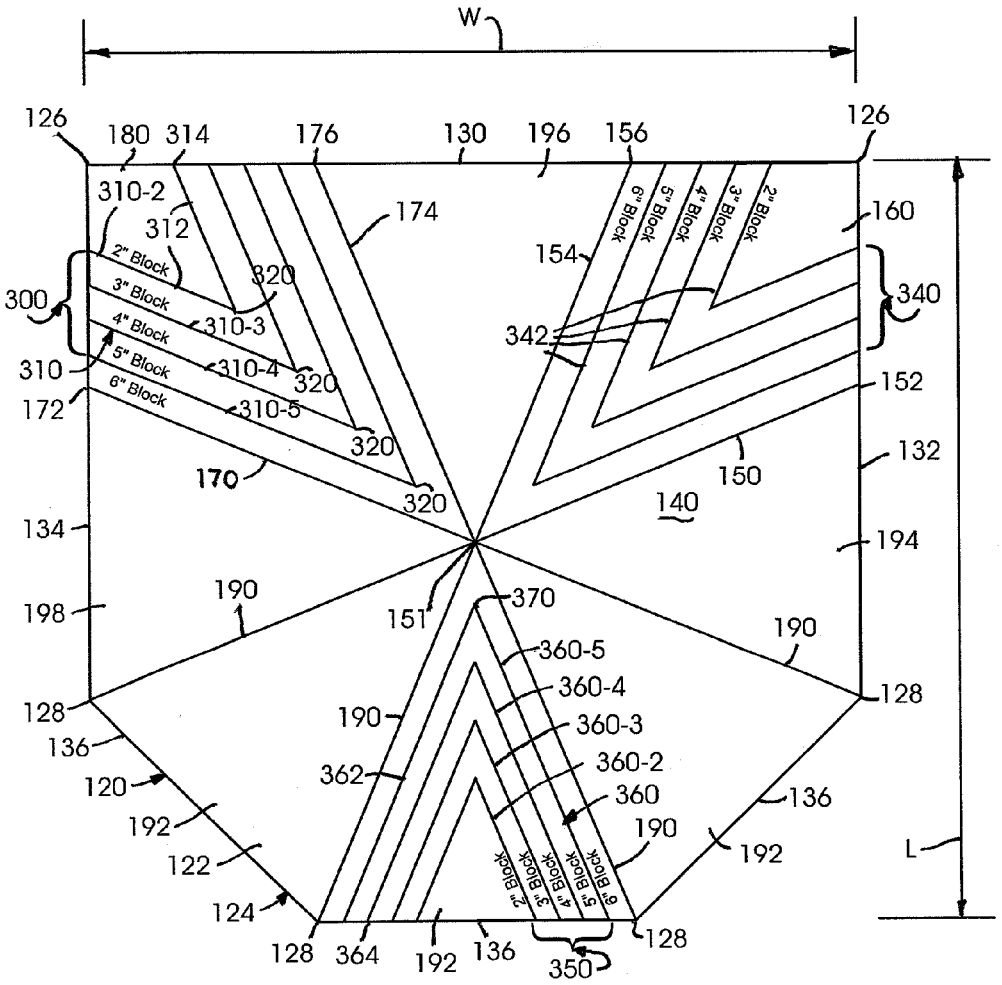
FIG. 3 is a top plan view of a template constructed in accordance with the present invention.
Figure 4:
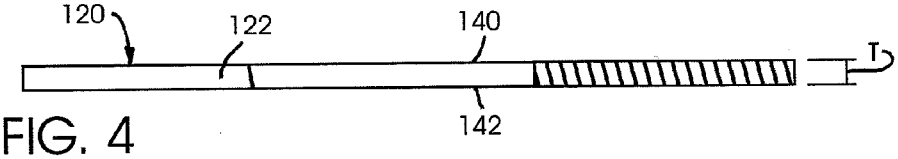
FIG. 4 is a side elevational view of the template.

Referring now to FIGS. 3 and 4, a template constructed in accordance with the present invention is illustrated at 120 and is seen to be in the form of a relatively flat plate 122 having a thickness T, as viewed in FIG. 4, which is relatively small compared to the overall length L and width W of the template 120, as viewed in FIG. 3. Plate 122 preferably is constructed of an essentially transparent and relatively stiff synthetic polymeric material, such as a methyl methacrylate or a polycarbonate. Template 120 is provided with structural elements which enable the template 120 to be used in accordance with the present invention for the creation of a quilt block incorporating either of the alternate eight-patch or twelve-patch versions of the kaleidoscope patterns described above. In the preferred configuration, template 120 includes a peripheral edge 124 having two right angle corners 126 and four obtuse angle corners 128. The right angle corners 126 are placed adjacent one another and the obtuse angle corners 128 are placed serially along the peripheral edge 124, opposite the right angle corners 126, each obtuse angle corner including an obtuse angle of 135°.

A plurality of cutting guides are provided along the peripheral edge 124 of template 120, as follows: A first cutting guide in the form of a cutting guide edge 130 extends along a straight line from one to the other of the right angle corners 126. Two second cutting guides are provided in the form of cutting guide edges 132 and 134 extending along respective straight lines, each straight line extending from a right angle corner 126 to an adjacent obtuse angle corner 128. Three third cutting guides are provided in the form of cutting guide edges 136 extending along straight lines from one obtuse angle corner 128 to an adjacent obtuse angle corner 128.

Template 120 further is provided with a plurality of registration indicators, preferably in the form of visible guide lines placed on one or the other of obverse face 140 and reverse face 142 of plate 122. A first guide line 150 extends radially outwardly from an origin 151 to a first location 152 on the peripheral edge 124 intermediate a right angle corner 126 and an adjacent obtuse angle corner 128. A second guide line 154 is adjacent the first guide line 150 and extends radially outwardly from the origin 151 to a second location 156 on the peripheral edge 124 intermediate the right angle corners 126. Thus, the adjacent first and second guide lines 150 and 154 delineate two sides of a generally diamond kite-shaped area 160 on the plate 122. A third guide line 170 extends radially outwardly from the origin 151 to a third location 172 on the peripheral edge 124 intermediate the other right angle corner 126 and an adjacent obtuse angle corner 128. A fourth guide line 174 is adjacent the third guide line 170 and extends radially outwardly from the origin 151 to a fourth location 176 on the peripheral edge 124 intermediate the right angle corners 126. Thus, the adjacent third and fourth guide lines 170 and 174 delineate two sides of another generally diamond kite-shaped area 180 on the plate 122. Further guide lines 190 extend radially outwardly from origin 151 to each obtuse angle corner 128 such that adjacent guide lines 190 delineate two sides of an isosceles triangle-shaped area 192 on the plate 122. In the preferred arrangement, pairs of adjacent ones of all of the guide lines 150, 154, 170, 174 and 190 are spaced apart circumferentially by an included angle of 45° and comprise corresponding segments of straight lines extending from an obtuse angle corner 128 through the origin 52 to an opposite corresponding location 152, 156, 172 and 176. Three further isosceles triangle-shaped areas are defined on the plate 122, namely, area 194 whose sides are delineated by guide line 150 and adjacent guide line 190, area 196 whose sides are delineated by adjacent guide lines 154 and 174, and area 198 whose sides are delineated by guide line 170 and adjacent guide line 190.

Figure 5:
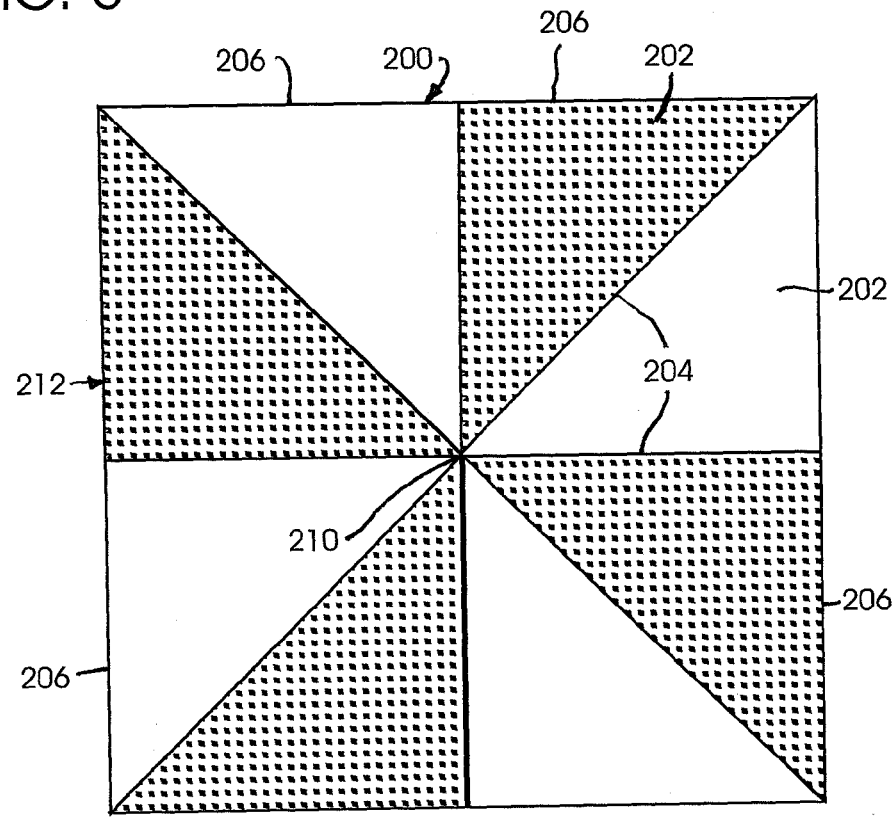
FIG. 5 is a plan view of a conventional pinwheel quilt block to be used as a quilting blank for the creation of a quilt block having a selected kaleidoscope pattern.

Template 120 is utilized in accordance with the present invention to create a quilt block having a selected one of the above-described alternate versions of a kaleidoscope pattern from a quilting blank having a generally conventional pattern of sections. As seen in FIG. 5, a quilting blank 200 is in the form of a quilt block having a conventional "pinwheel" pattern. The pinwheel pattern is relatively easy to construct, the pattern consisting of eight patches 202 in the form of congruent 45° triangle sections which are seamed together along seam lines 204 to establish the square quilting blank 200. Construction of the pinwheel pattern now is conventional and results in two patches 202 joined along juxtaposed hypotenuses to form a square 206 having a seam line 204 running along juxtaposed hypotenuses, and then four squares 206 of two triangular sections each, joined together to establish the larger square quilting blank 200 in which seam lines 204 intersect at a common seam origin 210. The seam lines 204 radiate outwardly from the origin 210 to the periphery 212 of the quilting blank 200 and are spaced from one another circumferentially by virtue of the 45° angle included between adjacent intersecting seam lines 204. Since the construction procedure merely involves arranging small squares into a larger square, and then joining the arranged small squares by sewing along orthogonal straight seam lines, the task is executed easily, even by novice quilters.

Figure 6:
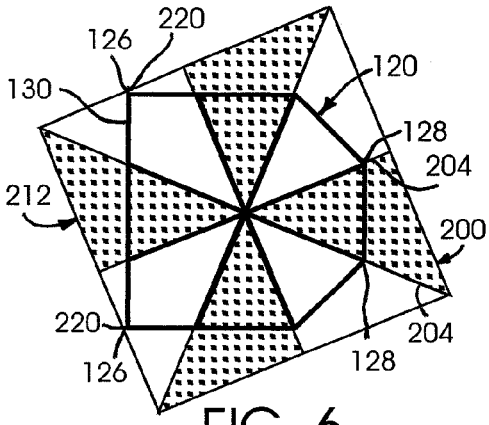
FIGS. 6 through 13 are diagrammatic views illustrating the creation of a quilt block incorporating the eight-patch version of the kaleidoscope pattern, the quilter using a left hand.

Turning now to FIGS. 6 through 13, as well as to FIG. 1, there are illustrated several steps in a procedure conducted in accordance with the present invention for creating the quilt block 40 having the eight-patch version of the kaleidoscope pattern, as described above in connection with FIG. 1. In this instance, the quilter is left-handed and the following describes a procedure best suited to a left-handed quilter. As seen in FIG. 6, template 120 is juxtaposed with quilting blank 200, prepared as described above in connection with FIG. 5. The relative dimensions of the template 120 and the quilting blank 200 are such that upon orienting the template 120 and the quilting blank 200 relative to one another so that at least two adjacent obtuse angle corners 128 are registered with adjacent seam lines 204 of the quilting blank 200, and the right angle corners 126 are placed toward the left, the right angle corners 126 will essentially coincide with the periphery 212 of the quilting blank 200 at peripheral locations 220, as seen in FIG. 6, and cutting guide edge 130 will extend at least from one to the other of peripheral locations 220, placed at the left of the template 120 and oriented for facilitating the execution of a cut along a corresponding cut line by the left-handed quilter who can hold the template 120 with the quilter's right hand while using the left hand to execute a cut along the cutting guide edge 130.

Figure 7:
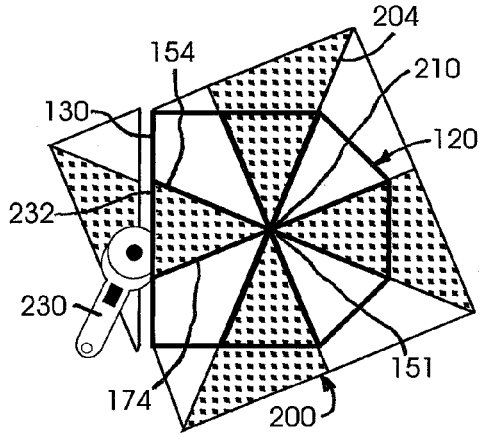

Once the template 120 and the quilting blank 200 are juxtaposed with one another, as illustrated in FIG. 6, a cutting tool 230 is guided by the quilter along cutting guide edge 130, as seen in FIG. 7, to establish a first segment 232 of the peripheral border 53 of the quilt block 40. The cutting tool 230 preferably is in the form of a rotary cutter, as shown; however, other cutting tools, such as a razor blade or a knife blade, can be used effectively. Accuracy of the cut is facilitated by the ability to view the seam lines 204 and the origin 210 through the template 120 and assure that at least the guide lines 154 and 174 are registered along corresponding seam lines 204, and that the origin 151 is registered with origin 210, so as to confirm the accurate relative positions of the template 120 and the quilting blank 200 prior to executing the cut. Such accurate relative positioning of the template 120 and the quilting blank 200 will assure accuracy in the completed quilt block 40, even if there may be some variation in the overall dimensions of the quilting blank 200.

Figure 8:
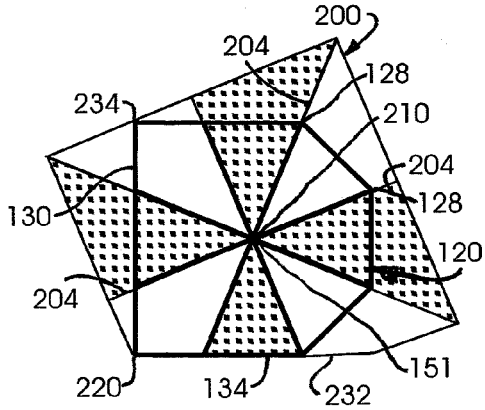

Subsequent to executing the first cut, as illustrated in FIG. 7, the template 120 and the quilting blank 200 are indexed relative to one another, preferably by rotating the quilting blank 200 relative to the template 120, to place the cut segment 232 of the peripheral border 53 of the quilt block 40 along the edge 134 of the template 120, with at least two adjacent obtuse angle corners 128 registered with adjacent seam lines 204, as seen in FIG. 8. The cutting guide edge 130 will then extend from a location 220 to another location 234 on the periphery of the quilting blank 200, and will remain oriented for facilitating execution by the left-handed quilter of a second cut along a cut line established by the cutting guide edge 130. Again, observation of the registration of guide lines 154 and 174 along corresponding seam lines 204, and registration of origin 151 with origin 210, will confirm accurate positioning of the template 120 and the quilting blank 200 relative to one another prior to executing the cut.

Figure 9:
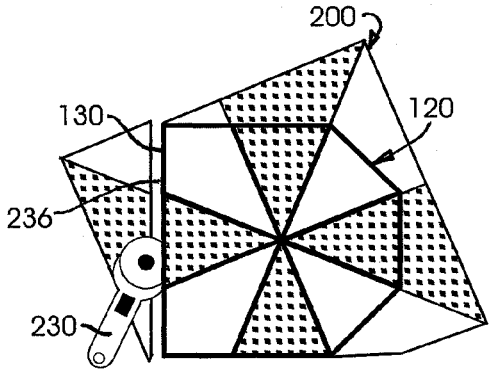
Figure 10:
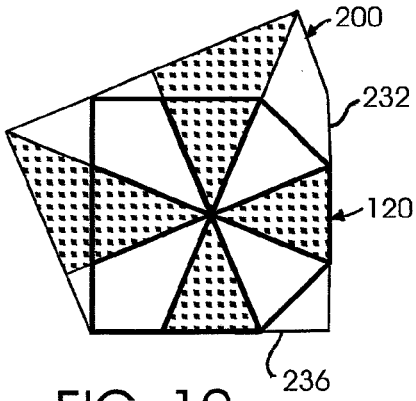
Figure 11:
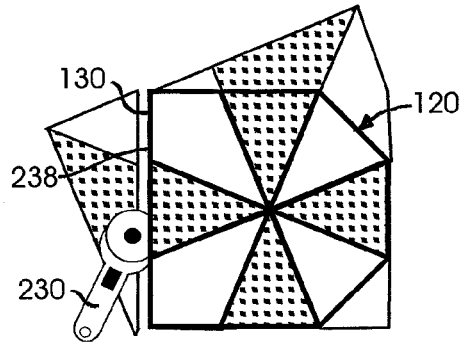
Figure 12:
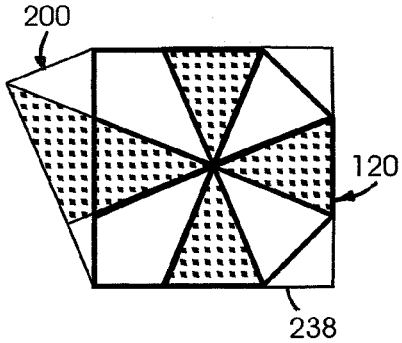
Figure 13:
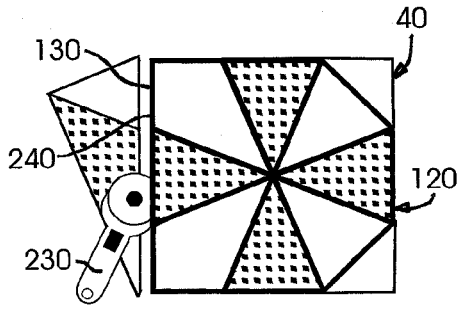
Figure 14:
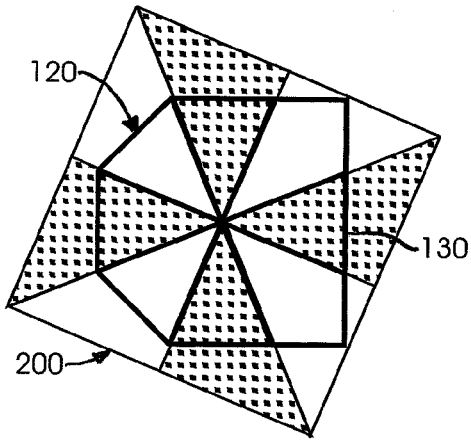
FIGS. 14 through 21 are diagrammatic views illustrating the creation of a quilt block incorporating the eight-patch version of the kaleidoscope pattern, the quilter using a right hand.
Figure 15:
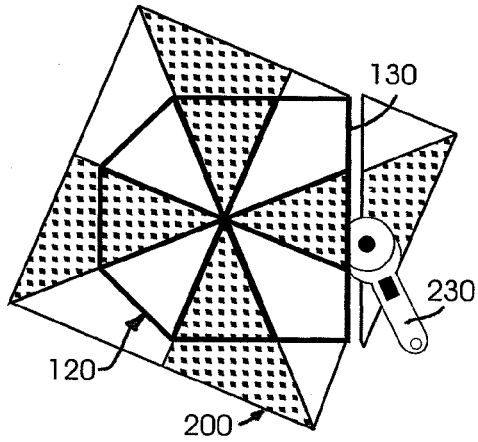
Figure 16:
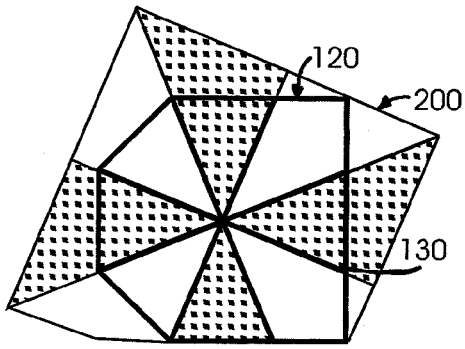
Figure 17:
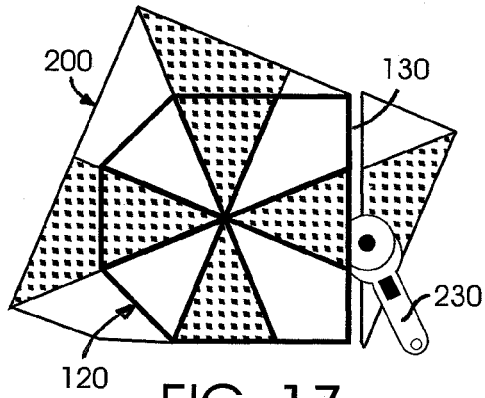
Figure 18:
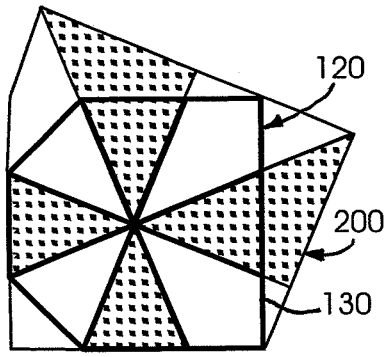
Figure 19:
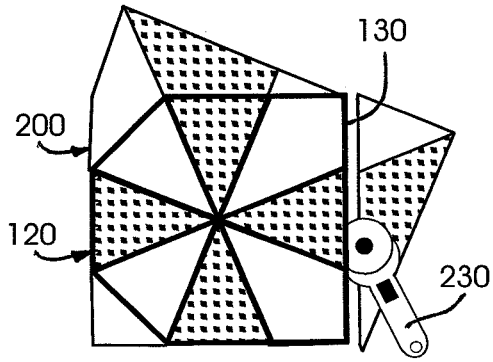
Figure 20:
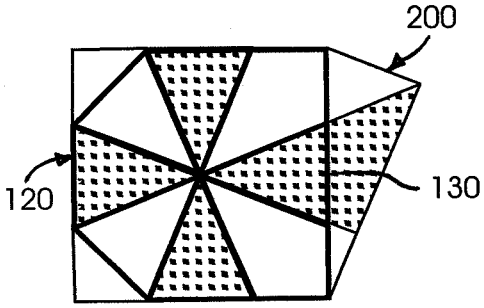
Figure 21:
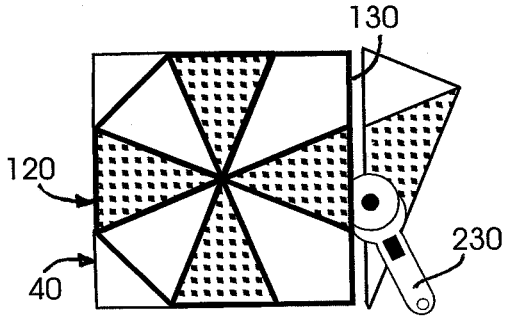

Once the template 120 and the quilting blank 200 are juxtaposed with one another as illustrated in FIG. 8, the cutting tool 230 is guided by the quilter along cutting guide edge 130, as seen in FIG. 9, to establish a second segment 236 of the peripheral border 53 of the quilt block 40. Subsequent to executing the second cut, as illustrated in FIG. 9, the aforesaid indexing step is repeated, as seen in FIG. 10, wherein the template 120 and the quilting blank 200 once more are indexed relative to one another, and the aforesaid cutting step is repeated, as illustrated in FIG. 11, wherein a third cut is executed to establish a third segment 238 of the peripheral border 53 of the quilt block 40. Subsequent to executing the third cut, as illustrated in FIG. 11, the aforesaid indexing and cutting steps are repeated once again, as seen in FIGS. 12 and 13, wherein the template 120 and the quilting blank 200 once more are indexed relative to one another, and a fourth cut is executed to establish a fourth segment 240 of the peripheral border 53 of the quilt block 40. Having executed the fourth cut, the quilt block 40 is complete, with the inclusion of the eight-patch kaleidoscope pattern 42 within the square quilt block 40, which is ready for incorporation into a full quilt.

Referring now to FIGS. 14 through 21, as well as to FIG. 1, there are illustrated several steps in another procedure conducted in accordance with the present invention for creating the quilt block 40 having the eight-patch kaleidoscope pattern 42, as described above in connection with FIG. 1. The steps of the present procedure are similar to those of the procedure set forth above in connection with FIGS. 6 through 13; however, in this instance, the quilter is right-handed and the procedure is best suited to a right-handed quilter. Thus, as seen in FIGS. 14 through 21, The template 120 is juxtaposed with the quilting blank 200 in relative orientations which are the mirror-image of counterpart orientations illustrated in FIGS. 6 through 13, so that the cutting guide edge 130 now is placed at the right of the template 120 and is oriented for facilitating the execution of each cut by the right-handed quilter who can hold the template 120 in place with the quilter's left hand while using the right hand to execute a cut along a cut line provided by the cutting guide edge 130.

Figure 22:
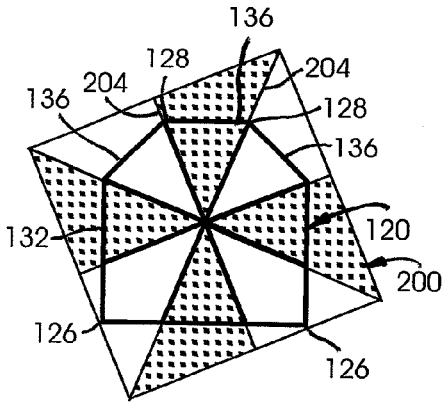
FIGS. 22 through 27 are diagrammatic views illustrating the creation of a quilt block incorporating the twelve-patch version of the kaleidoscope pattern, the quilter using a left hand.
Figure 23:
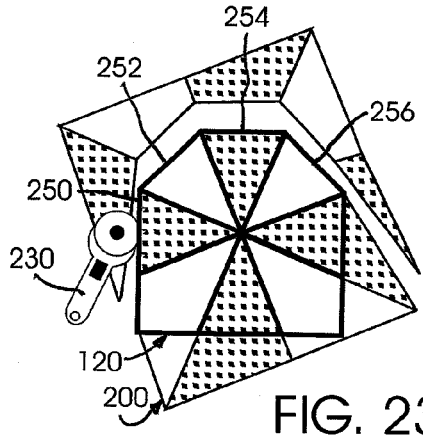

Turning now to FIGS. 22 through 27, as well as to FIG. 2, there are illustrated several steps in a procedure conducted in accordance with the present invention for creating the quilt block 80 having the twelve-patch kaleidoscope pattern 82, as described above in connection with FIG. 2. In this instance, the quilter is left-handed and the following describes a procedure best suited to a left-handed quilter. As seen in FIG. 22, template 120 is juxtaposed with quilting blank 200, prepared as described above in connection with FIG. 5. The relative dimensions of the template 120 and the quilting blank 200 are such that upon orienting the template 120 and the quilting blank 200 relative to one another so that at least two adjacent obtuse angle corners 128 are registered with adjacent seam lines 204 of the quilting blank 200, and the right angle corners 126 are placed toward the bottom, as viewed in FIG. 22, the cutting guide edges 132 and 136 will be situated so that the quilter is able to hold the template 120 in place with the quilter's right hand while executing cuts with the cutting tool 230 moved by the quilter's left hand, guided by the cutting guide edges 132 and 136 to execute cuts along corresponding cut lines and establish segments 250, 252, 254 and 256 along the quilting blank 200, as seen in FIG. 23.

Figure 24:
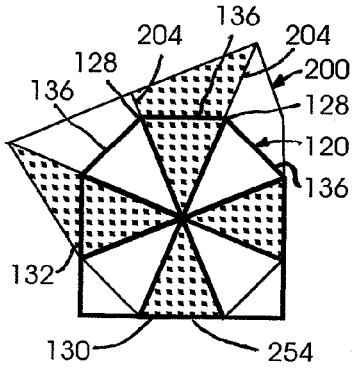
Figure 25:
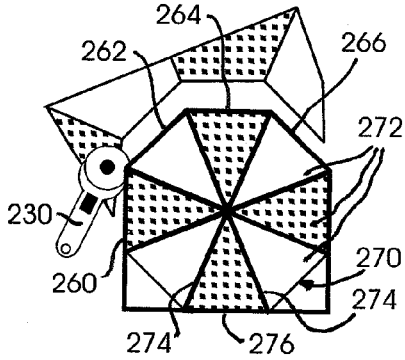

Subsequent to executing the initial cuts, as illustrated in FIG. 23, the template 120 and the quilting blank 200 are indexed relative to one another, preferably by rotating the quilting blank 200 relative to the template 120, to place the cut segment 252 of the quilting blank 200 along the now bottom edge 130 of the template 120, with at least two adjacent obtuse angle corners 128 registered with corresponding adjacent seam lines 204, as seen in FIG. 24. The cutting guide edges 132 and 136 then are used to guide the cutting tool 230 during execution of further cuts in a manner similar to that described above in connection with FIG. 23, and establish segments 260, 262, 264 and 266, as shown in FIG. 25, thereby completing an intermediate blank 270 having eight patches 272, each in the form of an isosceles triangle, and all arranged in an overall octagonal configuration. Each patch 272 has sides 274 and a base 276, the contiguous sides 274 of abutting patches 272 being sewn together, with contiguous patches 272 having contrasting colors or designs and the bases 276 extending along the periphery of the octagonal configuration.

Figure 26:
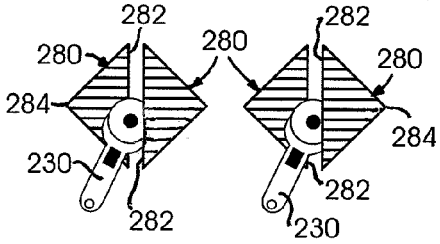
Figure 27:
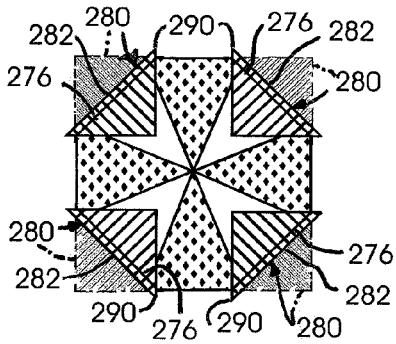
Figure 28:
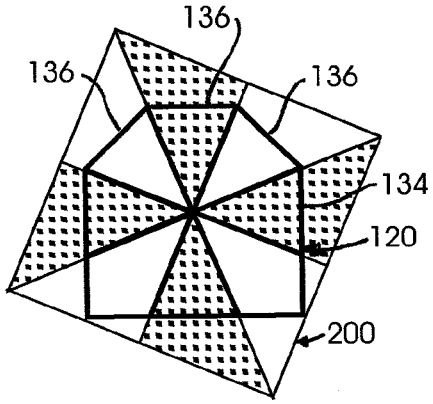
FIGS. 28 through 33 are diagrammatic views illustrating the creation of a quilt block incorporating the twelve-patch version of the kaleidoscope pattern, the quilter using a right hand.

As illustrated in FIG. 26, four corner patches then are prepared by dividing two square pieces, each along a diagonal, to create isosceles right-triangular corner patches 280, each having a hypotenuse 282 located opposite the right-angled corner 284 of the patch 280. Then, as seen in FIG. 27, the corner patches 280 are stitched along each hypotenuse 282 to corresponding alternate bases 276, and then the corner patches 280 are turned outwardly, to the position illustrated in phantom, to complete the quilt block 80 with the included twelve-patch kaleidoscope pattern 82. A small overlap 290 (see FIG. 2) along the seams where each corner patch 280 is sewn to a corresponding base 276 provides the quilt block 80 with peripheral material for joining the quilt block 80 with surrounding material without compromising the points 292 of the kaleidoscope pattern 82 when the quilt block 80 is integrated into a surrounding structure, such as a completed quilt.

Figure 32:
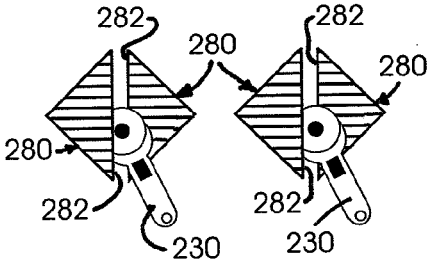
Figure 33:
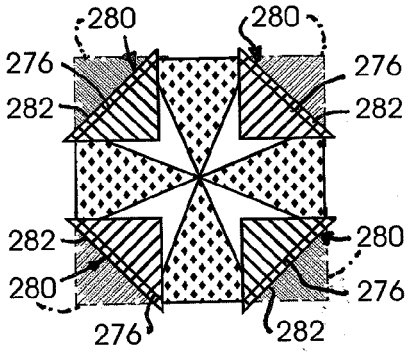

Referring now to FIGS. 28 through 33, as well as to FIG. 2, there are illustrated several steps in another procedure conducted in accordance with the present invention for creating the quilt block 80 having the twelve-patch kaleidoscope pattern 82, as described above in connection with FIG. 2. The steps of the present procedure are similar to those of the procedure set forth above in connection with FIGS. 22 through 27; however, in this instance, the quilter is right-handed and the procedure is best suited to a right-handed quilter. Thus, as seen in FIGS. 28 through 31, the template 120 is juxtaposed with the quilting blank 200 in relative orientations which are the same as the relative orientations shown in FIGS. 22 through 25; however, the cutting guide edges 134 and 136 are used to guide the cutting tool 230 during execution of cuts in a manner similar to that described above in connection with FIGS. 23 and 25, thereby completing intermediate blank 270 having eight patches 272, each in the form of an isosceles triangle, and all arranged in an overall octagonal configuration. As illustrated in FIG. 32, four corner patches then are prepared by dividing two square pieces, each along a diagonal, to create isosceles right-triangular corner patches 280, each having a hypotenuse 282 located opposite the right-angled corner 284 of the patch 280. Then, as seen in FIG. 33, the corner patches 280 are stitched along each hypotenuse 282 to corresponding alternate bases 276, and then the corner patches 280 are turned outwardly, to the position illustrated in phantom, to complete the quilt block 80 with the included twelve-patch kaleidoscope pattern 82.

In the embodiments of the invention described above, template 120 has a length L of six and one-half inches and a width W of six and one-half inches, and is used to create quilt blocks 40 and 80, each of which, when finished, is six inches square, but is six and one-half inches square prior to integration into a completed quilt so as to provide a surrounding one-quarter inch seam allowance. The pinwheel block used as quilting blank 200 then is constructed to be eight and one-half inches square for creating a six-inch square quilt block 40, or seven inches square for creating a six-inch square quilt block 80.

In order to enable the use of template 120 in creating smaller quilt blocks incorporating one or the other of the same kaleidoscope patterns 42 and 82, supplemental guide lines are provided on the template 120. Thus, a seen in FIG. 3, a first set 300 of supplemental guide lines is provided for creating quilt blocks 40 in one of four selectable sizes and includes four V-shaped guide lines 310 nested between primary guide lines 170 and 174, each having branches 312 extending parallel to corresponding primary guide lines 170 and 174, from ends 314 located at the peripheral edge 124 of the template 120 to a vertex placed at a respective supplemental origin 320. Each V-shaped guide line 310 is labeled to indicate the finished size of the quilt block 40 to be created, i.e., the V-shaped guide lines are designated as 310-2 for a two-inch square quilt block, 310-3 for a three-inch square quilt block, 310-4 for a four-inch square quilt block, 310-5 for a five-inch square quilt block, while the primary guide lines 170 and 174 serve to create the six-inch square quilt block, as described above.

Figure 34:
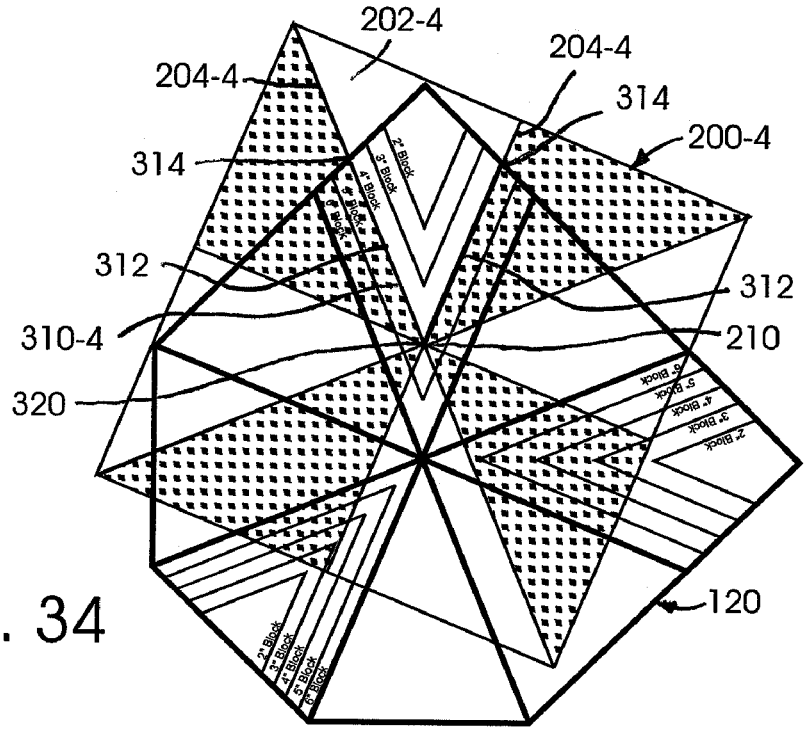
FIGS. 34 and 35 are diagrammatic views illustrating the creation of a smaller quilt block incorporating the eight-patch version of the kaleidoscope pattern.
Figure 35:
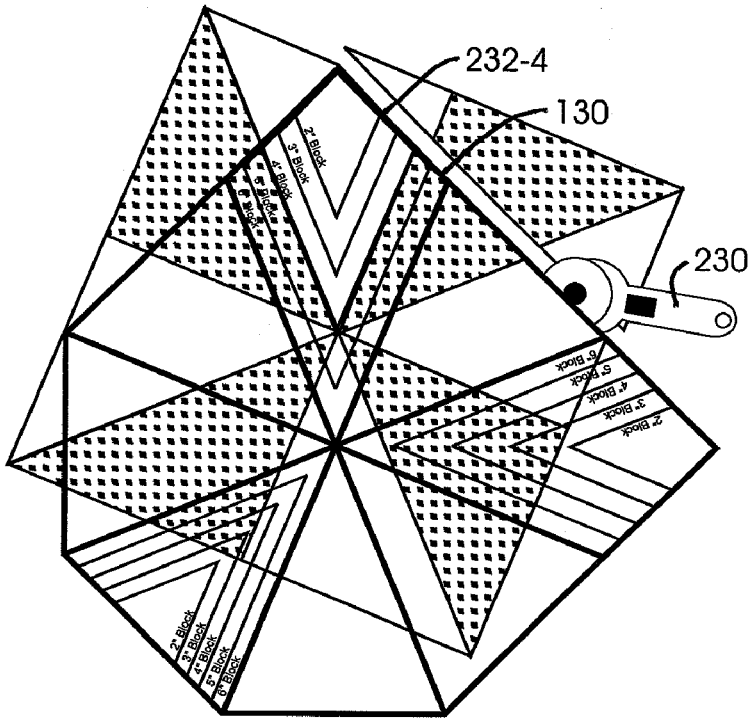

Referring now to FIGS. 34 and 35, there is illustrated, as an example, steps utilized by a right-handed quilter for the creation of a four-inch square quilt block 40, which includes the eight-patch version kaleidoscope pattern 42 illustrated in FIG. 1. As shown, the template 120 is juxtaposed with a quilting blank 200-4 in the form of a pinwheel quilt block, as described above in connection with FIG. 5, with at least the ends 314 of the branches 312 of the supplemental V-shaped guide line 310-4 registered with corresponding seam lines 204-4 which delineate an initial patch 202-4 of the quilting blank 200-4. Accuracy is facilitated by observation to assure that the branches 312 are registered with respective seam lines 204-4, along the length of the seam lines 204-4, and that corresponding supplemental template origin 320 is registered with the origin 210 of the quilting blank 200-4, as illustrated in FIG. 34. Then, as shown in FIG. 35, cutting tool 230 is guided along cutting guide edge 130 to execute a first cut and create a first segment 232-4 of the border of the quilt block.

Once the first cut is complete, the template 120 and the quilting blank 200-4 are indexed relative to one another, preferably by rotating the quilting blank 200-4 relative to the template 120. The rotation is continued through 90° so as to skip the next adjacent patch 202-4 of the quilting blank 200-4 and place at least the ends 314 of the supplemental guide line 310-4 in registration with the seam lines 204-4 delineating a subsequent patch 202-4, spaced circumferentially 90° away from the initial patch 202-4, so that the template 120 and the quilting blank 200-4 are in a relative orientation similar to that illustrated in FIG. 34, but with the quilting blank 200-4 rotated through 90°. Then, another cut is made, in the manner illustrated in FIG. 35, to create a second segment of the border of the quilt block. The steps illustrated in FIGS. 34 and 35 are repeated until four cuts complete the four sides of the quilt block. The same procedure is followed for the creation of each quilt block 40 of a selected size.

In order to accommodate a left-handed quilter, a second set 340 of supplemental guide lines 342 is provided between primary guide lines 150 and 154, as seen in FIG. 3, the second set 340 being arranged for use in the same manner as the first set 300 described above in connection with FIGS. 34 and 35, with the exception that the arrangement will be a mirror-image of that described above to accommodate moving the cutting tool 230 with the left-hand.

As best seen in FIG. 3, template 120 is provided with a third set 350 of supplemental guide lines for the creation, in different selected sizes, of the quilt block 80, which includes the twelve-patch kaleidoscope pattern 82. Thus, the third set 350 includes four V-shaped guide lines 360 nested between primary guide lines 190, with branches 362 extending parallel to corresponding primary guide lines 190, from ends 364 located at the peripheral edge 124 of the template 120 to a vertex placed at a respective supplemental origin 370. Each V-shaped guide line 360 is labeled to indicate the size of the quilt block 80 to be created, i.e., the V-shaped guide lines are designated as 360-2 for a two-inch square quilt block, 360-3 for a three-inch square quilt block, 360-4 for a four-inch square quilt block, 360-5 for a five-inch square quilt block, while the primary guide lines 190 serve to create the six-inch square quilt block 80, as described above.

Figure 36:
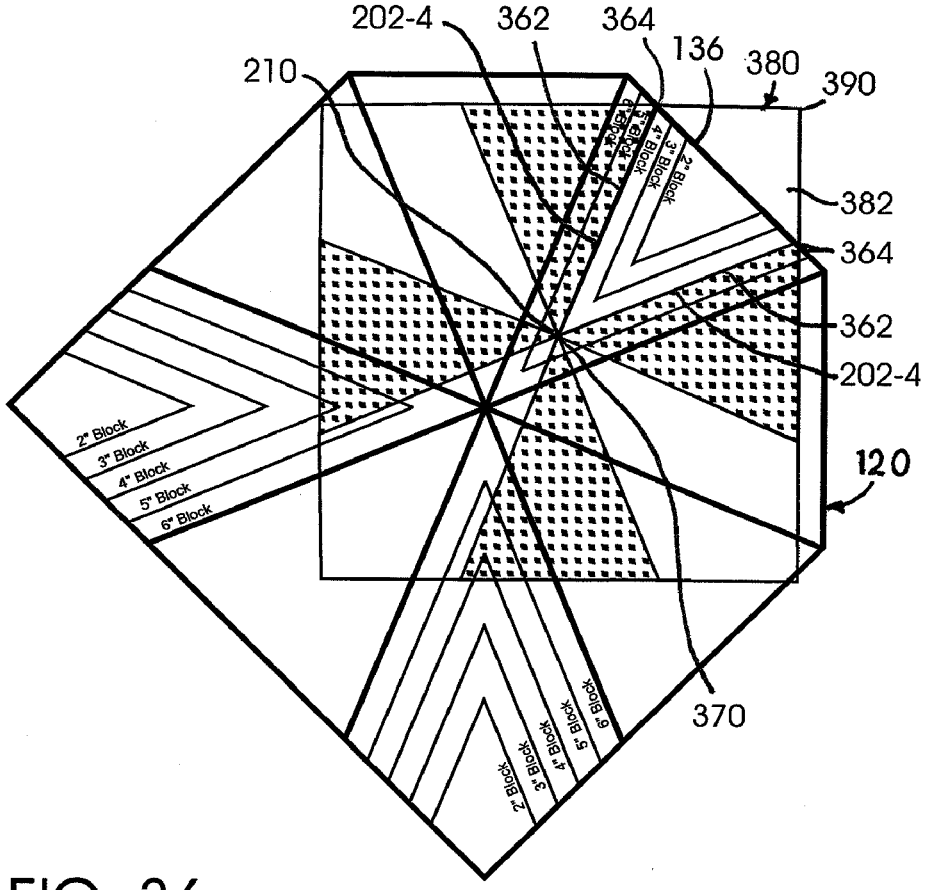
FIG. 36 is a diagrammatic view illustrating the creation of a smaller quilt block incorporating the twelve-patch version of the kaleidoscope pattern.

Turning now to FIG. 36, as well as to FIG. 2, using as an example the creation of a four-inch square quilt block 80, a four-inch square quilt block 40 created as described above in connection with FIGS. 34 and 35 is employed as an intermediate blank 380 and is juxtaposed with template 120 in a relative orientation in which the ends 364 of the branches 362 of the guide lines 360-4 are registered with seam lines 202-4 which now delineate a diamond kite-shaped patch 382. Once having assured accuracy by observing registration of the branches 362 along the length of corresponding seam lines 202-4, and registration of supplemental origin 370 with the origin 210 of the intermediate blank 380, a cut is made, using the cutting guide edge 136, to trim away a corner piece 390 of the diamond kite-shaped patch 382. The intermediate blank 280 and the template 120 then are indexed relative to one another by a rotation of 90° to place the cutting guide edge 136 in position for trimming away a corner piece 390 of the next consecutive diamond kite-shaped patch and the appropriate cut is executed.

Figure 29:
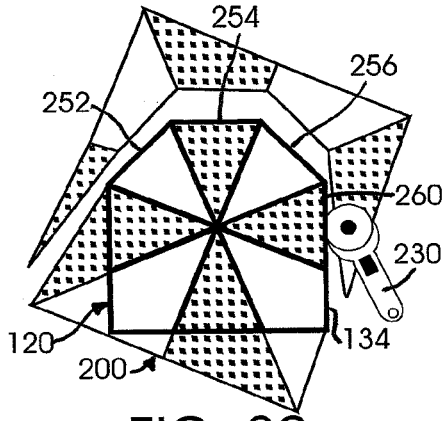
Figure 30:
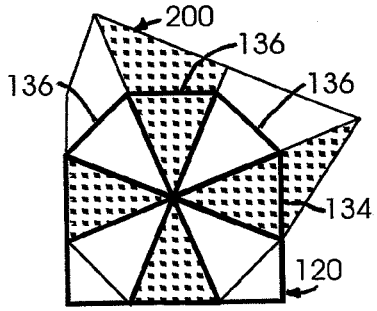
Figure 31:
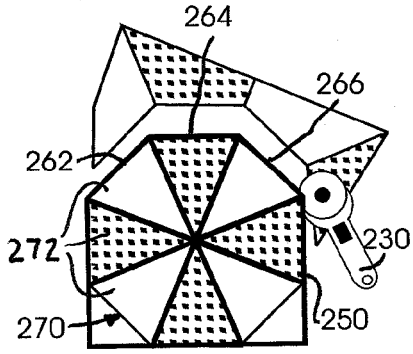

The steps are repeated until all four corner pieces are trimmed away, leaving behind an octagonal intermediate blank similar to that illustrated at 270 in FIGS. 23 and 29. Then, as described above in connection with FIGS. 26 and 27, suitable corner patches are cut and sewn to the trimmed diamond kite-shaped patches to complete the quilt block 80. It is noted that only one set 350 is required for accommodating both right-handed and left-handed quilters, since cutting guide edge 136 can be placed either to the right or to the left when trimming the corner pieces 390 from the diamond kite-shaped patches.

As set forth above, in accordance with the present invention, the dimensions of a pinwheel block to be employed as a quilting blank for the creation of a quilt block incorporating a kaleidoscope pattern must be greater than the those of the completed kaleidoscope-patterned quilt block. Thus, the six-inch square quilt block 40 requires an eight and one-half inch square pinwheel block for use as the quilting blank 200. Likewise, a two-inch square kaleidoscope-patterned quilt block 40 created in accordance with the present invention requires a three and one-half inch square pinwheel block; a three-inch square kaleidoscope-patterned quilt block 40 requires a four and three-quarter inch square pinwheel block; a four-inch square kaleidoscope-patterned quilt block 40 requires a six inch square pinwheel block; and a five-inch square kaleidoscope-patterned quilt block 40 requires a seven and one-quarter inch pinwheel block. The six-inch square quilt block 80 requires a seven inch square pinwheel block for use as the quilting blank 200. Likewise, a two-inch square kaleidoscope-patterned quilt block 80 created in accordance with the present invention requires a two and three-quarter inch square pinwheel block; a three-inch square kaleidoscope-patterned quilt block 80 requires a four inch square pinwheel block; a four-inch square kaleidoscope-patterned quilt block 80 requires a five inch square pinwheel block; and a five-inch square kaleidoscope-patterned quilt block 80 requires a six inch pinwheel block.

The present invention enables a quilter to create a relatively complex kaleidoscope-patterned quilt block without the necessity for concomitant complex sewing operations in order to assure accuracy in the completed quilt block. Thus, a quilter need merely construct a relatively simple and easy-to-sew quilting blank, and then use the present invention to quickly and accurately convert the simple quilting blank to the more complex quilt block having a highly-desired kaleidoscope pattern.

It will be seen that the present invention attains all of the objects and advantages summarized above, namely: Provides a single template, of relatively simple design and construction, for use in creating a quilt block having a selected one of alternate kaleidoscope patterns; simplifies the procedure in creating a quilt block having a selected kaleidoscope pattern; promotes accuracy of detail in a quilt block having a kaleidoscope pattern; reduces the time necessary to create a quilt block having a kaleidoscope pattern; enables even a novice quilter to create a more intricate kaleidoscope patterned quilt block with ease, utilizing a simple, more basic quilt block as a starting blank; provides a single template for creating kaleidoscope patterned quilt blocks of different sizes, all with increased ease; encourages quilters to move forward toward developing greater skill in creating a wider variety of quilt designs; makes available an easy-to-use simple and inexpensive template for widespread use in creating quilts bearing highly desirable kaleidoscope patterns.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A template for guiding a cutting tool during cutting of a quilt block having a selected one of at least two alternate kaleidoscope patterns from a quilting blank having a given pattern of sections seamed together along seam lines intersecting at a common seam origin, the selected kaleidoscope pattern having a prescribed peripheral border, the template comprising:

a plate having a peripheral edge including a plurality of cutting guides extending along the peripheral edge, the peripheral edge including at least two right angle corners and at least four obtuse angle corners; and at least two adjacent registration indicators on the plate, the registration indicators being arrayed circumferentially about a template origin and spaced apart in circumferential directions such that upon first registering the two adjacent registration indicators and the template origin respectively with two adjacent seam lines and the seam origin of the quilting blank, at least one cutting guide will be located for guiding the cutting tool along a cut line corresponding to a segment of the border of the selected kaleidoscope pattern, and upon indexing the plate and the quilting blank relative to one another to register the two adjacent registration indicators and the template origin respectively with another two adjacent seam lines and the seam origin of the quilting blank, the one cutting guide will be relocated for guiding the cutting tool along another cut line corresponding to another segment of the border of the selected kaleidoscope pattern.

2. The template of claim 1 wherein the plate is essentially transparent and the registration indicators include visible guide lines extending between the template origin and the peripheral edge.

3. The template of claim 1 wherein the at least four obtuse angle corners are arranged serially along the peripheral edge of the plate, and the template includes cutting guides extending between adjacent obtuse angle corners.

4. The template of claim 1 wherein the at least two right angle corners are adjacent one another, and the cutting guide includes a cutting guide edge extending between the two right angle corners.

5. The template of claim 4 wherein the cutting guide edge extends along a straight line from one to the other of the two right angle corners.

6. The template of claim 4 wherein the at least four obtuse angle corners are arranged serially in adjacent pairs of obtuse angle corners located along the peripheral edge of the plate opposite the cutting guide edge which extends between the two right angle corners, and a further cutting guide edge extends between each adjacent pair of obtuse angle corners.

7. The template of claim 6 wherein each further cutting guide edge extends along a straight line from one to the other of a corresponding pair of obtuse angle corners.

8. The template of claim 6 including two still further cutting guide edges, one each of the still further cutting guide edges extending between a right angle corner and an adjacent obtuse angle corner.

9. The template of claim 8 wherein each still further cutting guide edge extends along a straight line from one to the other of a right angle corner and an adjacent obtuse angle corner.

10. The template of claim 9 wherein each obtuse angle corner includes an obtuse angle of 135°.

11. The template of claim 6 wherein the plate is essentially transparent, and the two adjacent registration indicators include a first visible guide line extending between the template origin and a first location on the peripheral edge intermediate a right angle corner and an adjacent obtuse angle corner, and a second visible guide line extending between the template origin and a second location on the peripheral edge intermediate the adjacent right angle corners such that the first and second visible guide lines delineate two sides of a generally diamond kite-shaped area on the plate.

12. The template of claim 6 wherein the plate is generally transparent, and the two adjacent registration indicators include visible guide lines extending between the template origin and adjacent obtuse angle corners such that the visible guide lines delineate two sides of a generally triangular area on the plate.

13. The template of claim 12 wherein the two sides are of equal length and the generally triangular area comprises a shape of an isosceles triangle.

14. The template of claim 6 wherein:

the plate is essentially transparent;

the two adjacent registration indicators include a first visible guide line extending between the template origin and a first location on the peripheral edge intermediate a right angle corner and an adjacent obtuse angle corner, and a second visible guide line extending between the template origin and a second location on the peripheral edge intermediate the adjacent right angle corners such that the first and second visible guide lines delineate two sides of a generally diamond kite-shaped area on the plate; and two further adjacent registration indicators include two further visible guide lines extending between the template origin and respective adjacent obtuse angle corners such that the two further visible guide lines delineate two sides of a generally triangular area on the plate.

15. The template of claim 14 wherein:

the first visible guide line extends from the template origin to the first location, and the second visible guide line extends from the template origin to the second location; and the two further visible guide lines extend from the template origin to the respective obtuse angle corners.

16. The template of claim 14 wherein the cutting guide edge extends along a straight line from one to the other of the two right angle corners, each further cutting guide edge extends along a straight line from one to the other of a corresponding pair of obtuse angle corners, and each still further cutting guide edge extends along a straight line from one to the other of a right angle corner and an adjacent obtuse angle corner.

17. The template of claim 16 wherein each obtuse angle corner includes an obtuse angle of 135°, and the guide lines include eight guide lines arrayed so as to extend from the template origin with adjacent guide lines making an included angle of 45°.

18. A method for guiding a cutting tool during cutting of a quilt block having a selected one of at least two alternate kaleidoscope patterns from a quilting blank having a given pattern of sections seamed together along seam lines intersecting at a common seam origin, the selected kaleidoscope pattern having a prescribed peripheral border, the method comprising:

providing a template having a peripheral edge including a plurality of cutting guides extending along the peripheral edge, the peripheral edge including right angle corners and obtuse angle corners, and at least two adjacent registration indicators on the template, the registration indicators being arrayed circumferentially about a common template origin and spaced apart in circumferential directions;

registering the two adjacent registration indicators and the template origin respectively with two adjacent seam lines and the seam origin of the quilting blank to locate at least one cutting guide along a cut line corresponding to a first segment of the border of the selected kaleidoscope pattern;

guiding the cutting tool along the cutting guide to cut the first segment of the border of the selected kaleidoscope pattern;

indexing the template and the quilting blank relative to one another to register the two adjacent registration indicators and the template origin respectively with another two adjacent seam lines and the seam origin of the quilting blank to relocate the one cutting guide along a second cut line corresponding to a second segment of the border of the selected kaleidoscope pattern;

guiding the cutting tool along the cutting guide to cut the second segment of the border of the selected kaleidoscope pattern; and repeating the aforesaid indexing and cutting until the quilt block is complete.

19. A method for guiding a cutting tool during cutting of a quilt block having a selected one of at least two alternate kaleidoscope patterns from a quilting blank having a given pattern of sections seamed together along seam lines intersecting at a common seam origin, the selected kaleidoscope pattern having a prescribed peripheral border, the method comprising:

providing a template having a peripheral edge including a plurality of cutting guides extending along the peripheral edge, the peripheral edge including right angle corners and obtuse angle corners, the cutting guides including at least some cutting guides extending between adjacent obtuse angle corners, and adjacent registration indicators on the template, the registration indicators being arrayed circumferentially about a common template origin and spaced apart in circumferential directions;

registering adjacent registration indicators and the template origin respectively with adjacent seam lines and the seam origin of the quilting blank to locate the some cutting guides along cut lines corresponding to segments of the border of the selected kaleidoscope pattern;

guiding the cutting tool along the some cutting guides to cut segments of the border of the selected kaleidoscope pattern;

indexing the template and the quilting blank relative to one another to register adjacent registration indicators and the template origin respectively with further adjacent seam lines and the seam origin of the quilting blank to relocate the some cutting guides along further cut lines corresponding to further segments of the border of the selected kaleidoscope pattern; and guiding the cutting tool along the some cutting guides to cut the further segments of the border of the selected kaleidoscope pattern.

* * * * *